United States Patent [19]

Delluc

[11] 4,432,355

[45] Feb. 21, 1984

[54] HYDROMECHANICAL MASSAGING DEVICE

[76] Inventor: Rene Delluc, 2, Square du Berry, 91300 Massy, France

[21] Appl. No.: 347,677

[22] Filed: Feb. 10, 1982

[30] Foreign Application Priority Data

Mar. 10, 1981 [FR] France ..... 81 04739

[51] Int. Cl.[3] ..... A61H 7/00

[52] U.S. Cl. ..... 128/56; 128/66

[58] Field of Search ..... 128/45, 47, 56, 57, 128/65–67, 38, 37; 15/24, 29

[56] References Cited

U.S. PATENT DOCUMENTS

| | | | |
|---|---|---|---|
| Re. 30,500 | 2/1981 | Springer et al. | 128/57 |
| 2,048,712 | 7/1936 | Schramm | 128/67 |
| 4,327,454 | 5/1982 | Spence | 15/29 |
| 4,370,771 | 2/1983 | Gonzaluo | 15/29 |
| 4,374,444 | 2/1983 | Zhadonov | 15/29 |

FOREIGN PATENT DOCUMENTS

| | | | |
|---|---|---|---|
| 1566490 | 11/1970 | Fed. Rep. of Germany | 128/65 |

*Primary Examiner*—Richard J. Apley
*Assistant Examiner*—David J. Brown
*Attorney, Agent, or Firm*—Sughrue, Mion, Zinn, Macpeak and Seas

[57] ABSTRACT

A massaging device designed for hydrotherapy is provided with an hydromechanical drive capable of operating effectively in any position, even when the device is held in a vertical position or upside down.

The device comprises a paddle wheel (6) energized by water flowing from the mains through a duct (3) converging towards a distributor (5) from which the water flows tangentially to the wheel (6). Beyond the distributor, the water stream is smoothly guided by a gradually diverging arcuate side wall (16) towards an exhaust channel (18) lined by a concave wall (20) for directing the exhaust jet towards the massaging balls (12) which are freely rotating on studs (13) fixed on the tip of a drive shaft (11). This drive shaft is driven by the turbine wheel through a reducing gear enclosed in a water-tight housing (25), separated from the water circuit. The smooth guiding of the water stream by arcuate walls 16 and 20 ensures that this stream retains sufficient kinetic energy for forming a strong exhaust jet appropriate for hydrotherapy, irrespective of the position of the massaging device.

11 Claims, 2 Drawing Figures

HYDROMECHANICAL MASSAGING DEVICE

This invention relates to a hydromechanical massaging device which is appropriate for hydrotherapy. This device is provided with mobile bodies riding on the body of the user or patient for producing a massaging effect, as a rotary motion is imparted to these mobile bodies by a driving unit energized by a flow of water such as may be readily obtained from a tap connected to any public water distribution system. In addition, exhaust water released from the hydraulic motor with a sufficient residual kinetic energy is directed against the part of the patient's body which is being massaged, so as to produce a hydrotherapeutic effect.

BACKGROUND OF THE INVENTION

The effectiveness of massaging devices provided with mobile bodies has led to the design and production of various types of electrically-driven devices. However, these devices may not be used in the presence of water, owing to the risk of electric shock, so that it is not possible to use them for various types of hydrotherapy treatments combined with massaging.

Alternatively, it has been attempted to use, instead of an electric motor, various vibrating devices energized by a flow of water, but the effects of a vibratory massaging are very different from those of rotary mobile bodies riding on the patient's body.

Thus, there does not appear to have been available, from prior art, a simple and practical device adapted for being handled by a massager or by the patient himself, provided with ball-shaped rotary bodies which may be firmly applied on the patient's body while having sufficient driving force for sustaining their rotary motion and simultaneously releasing water with sufficient kinetic energy for producing an effective hydrotherapeutic action.

Rotary devices energized by water pressure have been described for driving circular brushes intended for washing automobiles. One such device, described in French Pat. No. 1,568,301 comprises a small turbine driven by the flow of water from a public distribution network. However, while such a device may be appropriate for driving a circular brush gliding over the smooth surface of a car body which is abundantly irrigated with water, this type of device is completely inappropriate for supplying the driving power requested for driving mobile bodies while these are firmly applied against a patient's limbs. Also, water flowing out of such a brush-driving device flows all around the brush, so that its residual kinetic energy is completely dissipated. It will be clearly apparent that such a device could not be used as a massaging device in hydrotherapeutic treatments, since the exhaust water would simply trickle away from the body part which is being massaged, whenever the device is turned sideways or upwards.

SUMMARY OF THE INVENTION

The present invention is concerned with a hydromechanical massaging device appropriate for hydrotherapy. This device is of the kind comprising ball-shaped bodies, each one of which revolves freely about its supporting shaft while these individual supporting shafts are rigidly linked with a main driving shaft, parts of this device being further designed so as to direct one or several streams of water along specific directions.

According to the invention, the power unit for driving the main shaft is a paddle wheel running inside a distributor housing, this unit being adapted for being energized by water flowing at a pressure comprised approximately between 4 and 8 bars (58–116 psi), while the distributor housing comprises an arcuate side wall extending tangentially beyond the circular path of the tips of the wheel vanes, so as to form a gradually widening outlet beyond an annular cavity portion defined by the paddle wheel with a bottom platen of the housing and an upper lid of this housing respectively laying in close vicinity to the lower and upper edges of the wheel vanes, while the side wall gradually spreads out beyond the said annular portion so as to guide the water stream which has been driving the wheel directly through an exhaust channel to the outside of the device, this device further comprising a speed-reducing gear train separated from the water circuit and connecting the turbine shaft to the main shaft driving the ball-shaped massaging bodies.

Thus, contrarily to earlier massaging devices provided with an electric motor which made it impossible to use these devices for hydrotherapy, it now becomes possible to drive balls riding on the patient's body while simultaneously taking advantage of the water jet issuing from the turbine with sufficient residual kinetic energy for being impelled along a predetermined direction towards the region which is massaged. This kind of effect was obviously impossible with the circular washing brush described in the above-mentioned earlier patent, in which water flows smoothly all around the brush under the sole effect of gravity after having lost all its cinetic energy within the water-filled enclosures of the driving gears.

Another feature of the invention consists in the arrangement of the massaging balls, which are brought relatively close together, so that they revolve within a circle having approximately the same diameter as the turbine wheel, while the main drive shaft supporting the individual shafts of these balls is located aside from the jet of water springing out of the turbine housing towards the balls.

A further feature consists in the combination of this arrangement with a speed reduction ratio allowing the main drive shaft to run at a rate of about 50 to 200 revolutions per minute corresponding to a rate of about 600 to 1,500 revolutions per minute for the turbine wheel, the diameter of which is from 6 to 15 centimeters, approximately. Experience has shown that this feature has the result that the rotary motion of the massaging balls cannot be hindered, even when they are very firmly pressed against the patient's body.

Yet another feature, which makes it possible to use the device in any position, including a vertical or an upside-down position, or while its position is being changed, consists in providing around the turbine wheel a second arcuate side wall closely enclosing this wheel and extending from the edge of the exhaust water outlet to the distributor, and also providing a deflector extending from the same edge to the external wall of the housing for guiding exhaust water away from the space comprised between said second side wall and the turbine wheel.

Thus, while the arcuate shape of the distributor wall defining an annular enclosure within which the turbine wheel is driven by the water stream and of the gradually diverging extension of this wall towards the exhaust outlet is per se a sufficient means for effectively guiding the jet out of the device, the provision of a second arcuate wall around the other side of the turbine and of the above-mentioned deflector brings additional safety against any possible accumulation of water which might result from an accidental disturbance of the water stream across the outlet duct, and cause small projections of water between the edges of the first and second sidewalls of the turbine housing.

This arrangement may yet be further improved by providing an outlet duct which is relatively wide and lined by a wide concave surface for shaping the emerging jet into a wide fluid sheet which may be used such as it is or else be subdivided, according to the effects being required.

Further features and advantages of the invention will be apparent from the following description with reference to the appended drawing representing an example of an embodiment of the invention in which.

DETAILED DESCRIPTION OF THE DRAWING

Figure 1:
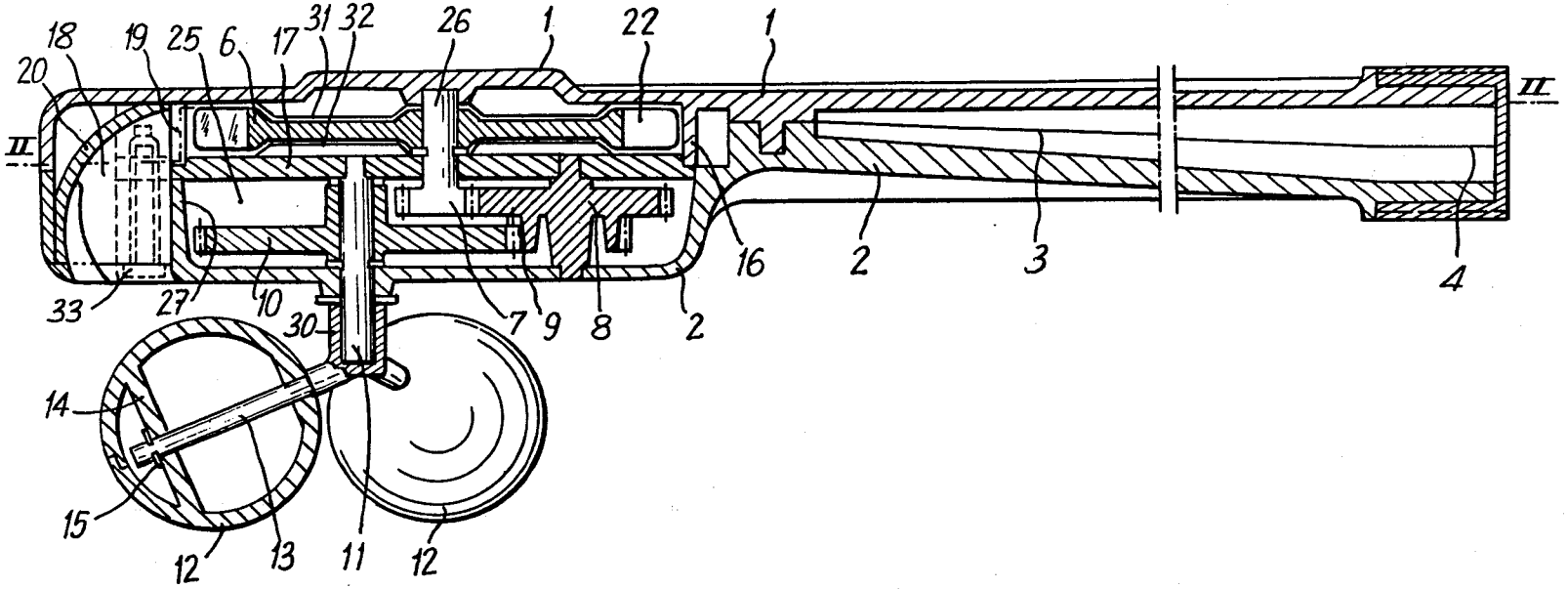
FIG. 1 is a longitudinal cross-section along line I—I of FIG. 2.
Figure 2:
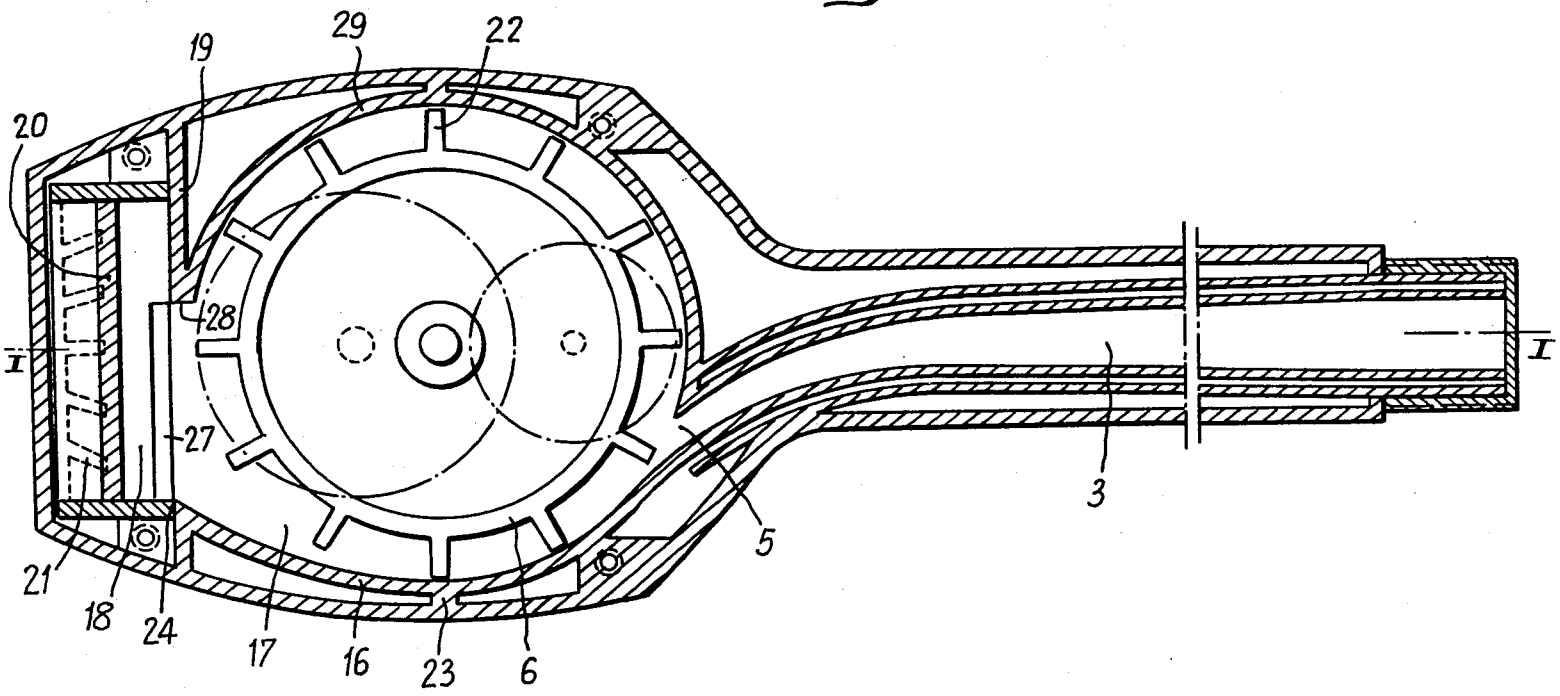
FIG. 2 is a longitudinal cross-section along line II—II of FIG. 1, showing the turbine wheel seen from above.

FIG. 1 shows the massaging device provided with an external housing made of two half-shells 1 and 2 which may be plastic mouldings and are assembled together by any suitable means such as by welding, glueing, fastener screws, etc . . . which may optionally allow a dismantling of the device for maintenance if needed.

The device is preferably provided with a hollow handle containing an inlet duct 3 converging from its inlet end 4 towards a distributor 5, the cross-section of which is much smaller than the inlet cross-section. Inlet 4 may be connected by any suitable means to a flexible hose which may in turn be connected to the water mains, for instance to a shower circuit in a bathroom.

The outline of distributor 5 comprises a first arcuate sidewall 16 which closely surrounds the tips of the vanes 22 of the turbine wheel 6, at first, and then gradually diverges away from the turbine wheel beyond a point 23 located approximately 75° away from the upstream end of the distributor. This extension of sidewall 16 remains concave throughout and its distal end 24 joins one lateral edge of a passage opening into an outlet duct 18. The upper side of duct 18 is lined by a concave surface 20 formed in the upper half-shell 1 of the housing. Duct 18 is further confined by a transverse wall 27 formed in the lower half-shell 2 of the housing, this wall 27 forming part of an enclosure 25 inside which is contained the reducing gear connecting the shaft 26 of the turbine wheel 6 to the output shaft 11. Enclosure 25 is further confined on its upper side by a platen 17 forming the bottom of the turbine chamber and on its lower side by the lower half-shell 2 of the external housing.

Inorder to avoid any accidental turbulence in the flow of water which will normally be gliding smoothly along the concave surface 20 of duct 18, such turbulence being liable to cause a slit projection of water when the device is being held upside down or in a vertical position, there is further provided a small deflector 19 which extends beyond the downstream edge 28 of transverse wall 27.

A second arcuate sidewall 29 is provided on the side opposite to the above-described first sidewall 16, which extends downstream of distributor 5. This second sidewall 29 is also closely surrounding the tips of the turbine vanes 22 all the way from the downstream edge 28 of transverse wall 27 to the distributor inlet 5. Thus, any small fortuitous projection of water will immediately be recaptured by the turbine vanes 22 and will then merge with the high-velocity jet coming out of the distributor 5. Experience has shown that, with this arrangement, the efficiency of the turbine is never impaired, whatever the position of the massaging device.

The reducing gear comprises a small pinion 7 on the turbine shaft 26, running across the platen 17. This pinion meshes with a larger pinion 8 which is integrated with another small pinion 9 meshing with a second large pinion 10 on the outlet shaft 11. This main shaft 11 driven by pinion 10 is directly driving short studs 13, each one of which carries a freely rotating ball 12. These balls may for instance be formed of two half-shells assembled together and provided with internal ribs 14 against which will rest a resilient washer 15 mounted on the tip of stud 13, so that after a ball 12 has been assembled, it will be permanently retained on its stud 13. The ball 12 rests externally against a bushing 30 carried on the tip of the main shaft 11.

Since the rotating balls 12 are fixed virtually directly over their studs 13, this ensures that these balls will sweep only a relatively small surface of the patient's body. Practically, this surface will be a circular surface having approximately the same diameter as the turbine wheel 6, which makes it possible to press the balls quite firmly against the patient's body without causing the speed of the turbine wheel to decrease appreciably. This will be true even if the massaging device is held upside down or in a vertical position, since all the water flowing along the arcuate sidewall 16 after driving the turbine wheel is immediately discharged at a high velocity as it glides along the concave surface 20 of the wide channel 18 which directs it towards the balls 12.

This preservation of the efficiency of the turbine is further enhanced by additional means for confining the stream of water as it leaves the distributor after point 23 where the sidewall 16 begins to diverge gradually away from the turbine wheel. These means consist in projections 31 and 32 of the inner walls of the half-shells 1 and 2 forming the external housing. These projections fill almost all the space comprised between the half-shells and the upper and lower faces of the turbine disk, so that the water stream is narrowly confined as it leaves the distributor zone and will hence hardly be disturbed by the turbine vanes 22 beyond this distributor zone.

Whereas in the example illustrated the lower half-shell 2 is assembled with upper half-shell 1 by means of screws 33, other fastening devices may also obviously be used. Various other modifications or additions may also be introduced without departing from the scope of the invention. One such possible addition may consist in ribs 21 projecting from the concave surface 20 in the exhaust duct for subdividing the water jet and/or for guiding this jet either towards the balls, where it will be periodically interrupted by the passage of the balls, or else towards any suitable other direction apart from the circular path of the balls.

Similarly, full advantage will be obtained from one of the essential features of the invention, which consists in guiding the water stream very closely around the turbine wheel along an arc comprised between about 40° and 100°, by substantially increasing the speed of this stream as it reaches distributor 5. This will further enhance the efficiency of the turbine. Thus, in addition to being closely guided around the turbine, the water stream is fed to the distributor 5 through a duct having a gradually decreasing section from its inlet 4 to the distributor. Preferably, the cross-sectional area of this duct at the inlet 4 will be from 4 to 5 times larger than the corresponding cross-sectional area at the junction with the distributor 5, the length of this duct running inside the handle of the massaging device being for instance comprised between about 10 to 20 centimeters. Also, the junction of the inlet duct with the distributor 5 will be preferably oriented along a tangent to the circle described by the tips of the vanes 22 of the turbine wheel 6.

The shaft 26 of the turbine will preferably be provided across platen 17 with a water-tight bushing preferably made of a polyamid resin or other material having excellent gliding properties and allowing the turbine shaft to run at a high speed without causing this bushing to overheat and soften, even when the massaging device is being used with hot water, while ensuring that frictional resistance will remain minimal.

Whereas until now no satisfactory hydromechanical drive system had been available for a massaging device adapted for hydrotherapy, in spite of the ever-growing requirements of the market, particularly for handicapped patients or persons otherwise prevented from taking proper physical exercise, the invention provides a hydromechanical massaging device which will operate effectively in any position and should thus provide a satisfactory answer to the above-stated requirements.

What is claimed is:

1. An hydromechanical massaging device for simultaneously applying mechanical and hydrotherapeutic massage to a patient's skin, comprising freely rotating balls carried on individual studs driven by a common shaft and at least one guided stream of water, and the features which consist of a shaft (11) driven by means of a paddle wheel (6) energized by water flowing at a pressure comprised between approximately 4 and 8 bars (58–116 psi) through a distributor (5) comprising a slide wall (16) which extends along a tangent to the circular path of the tips of the vanes (22) of said wheel (6) so as to form an extension of an annular cavity portion comprised between the periphery of the turbine wheel (6), a platen (17) forming the bottom of the turbine chamber and an upper wall (1), said platen (17) and said upper wall (1) respectively lying in close vicinity to the lower and upper edges of the vanes (22) of the turbine wheel, said side wall (16) gradually spreading out away from said annular portion so as to guide the water stream which has been driving the wheel (6) along a path which brings it directly to an exhaust channel (18) which is separated from, and located downstream from, the turbine wheel, and which exhausts a jet of water external to the device in a direction toward said balls and with sufficient kinetic energy to apply an hydrotherapeutic massage to the patient's skin; and a further feature consisting in transmitting the rotary motion of the turbine wheel (6) to the drive shaft (11) driving the rotary balls (12) by means of a reduction gear linking the shaft (26) of said wheel with said drive shaft (11), said reduction gear being isolated from the water circuit.

2. Massaging device according to claim 1 in which the balls (12) rotate around their common axis (12) along a peripheral path having a diameter in the same range as the turbine wheel (6).

3. Massaging device according to claim 2 in which the balls (12) pass in succession under the outlet of the water discharge channel (18).

4. Massaging device according to claim 2 in which the balls (12) are provided with internal retaining means such as a rib (14) cooperating with a washer (15) on the stud (13) carrying one of said balls for maintaining said balls on their carrier studs.

5. Massaging device according to claim 2, in which the reducing gear drives the shaft (11) for rotating the balls at a speed ranging from 50 to 200 revolutions per minute corresponding to a speed of the turbine wheel (6) ranging from 600 to 1,500 revolutions per minute, the diameter of said wheel being comprised between 6 and 15 centimeters.

6. Massaging device according to claim 1, in which the inlet to the water discharge channel (18) is bordered on one side by the side wall extension (16) of the distributor (5) and on its other side by a second side wall (29) extending from the downstream end (28) of said channel inlet to the distributor inlet (5) in close vicinity to the external path of the vanes (22) of the turbine wheel (6) so that both the mechanical and hydrotherapeutic massage functions of the device are insensitive to the position of the device.

7. Massaging device according to claim 1 or 6 comprising a small deflector member (19) located between the upper lid (1) and the platen (17) forming the bottom of the turbine chamber, said deflector extending transversally from the edge (28) of said second sidewall (29) enclosing a portion of the inlet to the discharge channel (18), said channel (18) being provided with a concave guiding surface (20) for shaping the exhaust stream of water into a fluid sheet directed outside the device and towards the patient's skin where the mechanical massaging action is effected.

8. Massaging device according to claim 7, in which the inner volume of the turbine chamber is confined by annular projections (31, 32) of the inside walls of the upper lid (1) of the device and of the platen (17) forming the bottom of said chamber, said projections extending in close vicinity to the turbine wheel (6).

9. Massaging device according to claim 8 in which the device handle is located opposite to the water discharge channel (18) and comprises a duct (3) converging towards the distributor (5), the cross-sectional area of the water stream in said duct being 4 to 5 times larger at the duct inlet than at the outlet of said duct where it reaches the distributor (5) along a tangent direction to the turbine wheel (6).

10. Massaging device according to claim 9, comprising a housing formed of an upper half-shell 1 and a lower half-shell 2 assembled together and preferably made of a plastic material, in which the pinions, the inner walls and the massaging balls are made of a plastic material while the drive shaft (11) carrying the balls is metallic and the turbine shaft (26) is provided with a polyamid bushing.

11. A combination mechanical and hydrotherapeutic device for simultaneously applying both a mechanical and an hydrotherapeutic massage to a patient's skin comprising:

a housing;

conduit means for applying to said housing a liquid under a pressure sufficient to produce an hydrotherapeutic massage to a patient's skin;

a turbine wheel rotatably mounted in said housing for rotation about an axis generally perpendicular to the direction of the flow of liquid in said conduit means;

channel means between said conduit means and said housing for directing the liquid flow tangentially to the periphery of said turbine wheel for rotating said turbine wheel;

rotatable mechanical massaging means, mounted in a plane parallel to, and displaced axially from, said turbine wheel, for mechanically massaging the patient's skin;

reduction gear means, coupled to said turbine wheel and mounted in a water-tight compartment in said housing, for rotating said mechanical massaging means;

liquid discharge means, separated from said mechanical massaging means and located downstream of said turbine wheel, communicating with said housing for directing the liquid along a path external to said housing and said mechanical massaging means in a direction toward said mechanical massaging means; and arcuate liquid guiding means, disposed around said turbine wheel and forming a continuous liquid flow path between said housing and said liquid discharge means, for causing the liquid to be discharged through said discharge means in the form of a jet having sufficient kinetic energy to produce hydrotherapeutic massaging of a patient's skin simultaneously with the mechanical massaging provided by said mechanical massaging means.

* * * * *